United States Patent [19]

McCorkle

[11] Patent Number: 4,488,646

[45] **Date of Patent: * Dec. 18, 1984**

[54] TAMPER-INDICATING SHEET

[75] Inventor: James L. McCorkle, Holden, Mass.

[73] Assignee: Ludlow Corporation, Needham Heights, Mass.

[ * ] Notice: The portion of the term of this patent subsequent to Oct. 4, 2000 has been disclaimed.

[21] Appl. No.: 538,345

[22] Filed: Oct. 3, 1983

Related U.S. Application Data

[62] Division of Ser. No. 007,400, Jan. 29, 1979, Pat. No. 4,407,443.

[51] Int. Cl.[3] ..... B65D 30/00; B42D 15/00; B41M 3/14; C08J 9/16

[52] U.S. Cl. ..... 206/459; 206/0.82; 283/94; 283/95; 427/7; 428/35; 428/916; 521/54; 524/274; 383/5

[58] Field of Search ..... 283/94, 95, 903; 383/5; 427/7; 428/35, 916; 521/54; 524/274; 206/0.82, 459

[56] References Cited

U.S. PATENT DOCUMENTS

| | | | |
|---|---|---|---|
| 3,414,998 | 12/1968 | Berger | 283/113 |
| 3,460,743 | 8/1969 | Burnett | 283/103 |
| 3,597,894 | 8/1971 | Harrison | 206/0.82 |
| 3,702,920 | 11/1972 | Taylor | 219/406 |
| 3,900,219 | 8/1975 | D'Amato et al. | 283/101 |
| 3,930,673 | 1/1976 | Sander | 283/105 |
| 3,931,061 | 1/1976 | Kohne, Jr. et al. | 521/146 |
| 3,956,049 | 5/1976 | Johnsen | 283/103 |
| 4,007,141 | 2/1977 | Wismer et al. | 521/140 |
| 4,033,611 | 7/1977 | Johnsen | 283/103 |
| 4,074,911 | 2/1978 | Stipek, Jr. | 283/105 |
| 4,120,445 | 10/1978 | Carrier et al. | 383/5 |
| 4,165,002 | 8/1979 | Meagher | 206/459 |
| 4,273,362 | 6/1981 | Carrier et al. | 283/903 |
| 4,407,443 | 10/1983 | McCorkle | 383/5 |

*Primary Examiner*—John E. Kittle
*Assistant Examiner*—José G. Dees
*Attorney, Agent, or Firm*—David G. Conlin

[57] ABSTRACT

A novel lottery ticket comprising a blush-type coating which coating is characterized by susceptibility to a change in appearance when exposed to either (a) any of a wide spectrum of organic solvents or (b) an elevated temperature. Such susceptibility reveals that solvent or thermal techniques have been used in tampering with the ticket or a pouch package in which the ticket is held. Such tampering is often the result of an illicit attempt to obtain information about the indicia printed on the ticket.

23 Claims, 3 Drawing Figures

TAMPER-INDICATING SHEET

This is a divisional application of U.S. application Ser. No. 007,400, filed Jan. 29, 1979, now U.S. Pat. No. 4,407,443, issued Oct. 4, 1983.

BACKGROUND OF THE INVENTION

The invention relates to an information-bearing construction such as a letter, ticket, etc. wherein indicia must remain undetected for effective utilization thereof by the intended recipient. A lottery ticket may serve as a model for such information-bearing members, but it should be obvious that it represents but one of many applications for such a construction. For example, such articles have substantial utility in the mailing of credit cards, transferral of such military information as code keys, the transferral of confidential business information and the like.

Blush coatings have been used in the construction of lottery tickets, of packages for lottery tickets, and of like items where it is desirable to detect tampering with the article by thermal means. See, for example, U.S. Pat. No. 4,120,445. In the aforesaid patent, it was also proposed to make a blush coating with a dye incorporated therein so that, on exposure of the coating to solvents, the dye would become solubilized, greatly increase its visibility and indicate the fact that the blush coating had been exposed to solvents.

This procedure, whereby dye was added to the blush-coating is found wanting in practice, especially when the blush coat is used in a pouch as defined in U.S. Pat. No. 4,120,445. A problem arises from the fact that, e.g., aliphatic-soluble dyes tend to bleed into a paper substrate and render a "false alarm" with respect to suspected tampering. In some cases the bleeding is slow and is better termed "migration." In such cases the dye migrates into the substrate paper and leaves an ambiguous coloration which may give a false indication of tampering to a customer if not to a more sophisticated inspector. Moreover, the dye tended to be soluble in oils present in the skin and become activated during handling.

As a consequence of these problems, it seemed necessary to remove the dye from the blush coating, at least in the areas of a ticket or pouch were it would tend to cause the aforesaid problems. As a practical matter, it was left that the blush coating was a detection means for thermal-tampering, and a separate dye layer was to be utilized for detection of solvent-tampering. The present inventor determined to find a practical way to combine thermal and solvent detection in a single coating system without encountering the problems described above.

SUMMARY OF THE INVENTION

It is a principal object of the invention to provide an improved blush coating which, when incorporated into a lottery ticket or like article, serves as a means to detect both solvent and thermal tampering.

It is a particular object of the invention to provide a blush coating useful in detection of both thermal and solvent tampering which blush coating does not contain solvent-activated dye particles.

Another object of the invention is to provide an information bearing article, whether a lottery ticket or other message-bearing article, which is so packaged that surreptitious attempts to read the information will be evident when such attempts use either thermal or organic solvent solubility techniques.

Other objects will be obvious to those skilled in the art on their reading of this disclosure.

The above objects are substantially achieved by development and use of blush coating compositions which utilize, in addition to a 'primary resin' which serves as the coalescing blush-importing resin by scattering light as is known in the art, a binder composition which serves as means to aid solvent-activated coalescence of the primary resin from a light-scattering configuration into a solid, normally transparent, configuration. It is important that this solvent susceptibility of the binder resin is not achieved at the cost of the required thermal properties of the blush coat. Thus, the temperature at which the binder allows coalescence of the primary resin particles is important also. As described below, some binders of the invention are readily susceptible to modification in such a way as to "fine tune" the temperature response of the blush system. This balance has been achieved by a careful selection of the binder system. "Normally-translucent," as used in this specification, means a condition into which the blush coating, in the absence of further colorants, will be transformed on the application of heat or solvents thereto. There will be some specialized embodiments of the invention where dyes or pigments may be added to the composition to serve a variety of functions. When such dyes or pigments are added, the blush coating will not convert to a normally-translucent state but will become opaque as a consequence of the dye or pigment additives. Nevertheless, it is contemplated that the primary use of the blush-coating will be in conjunction with a colored substrate and, upon coalescence of the blush, the colored substrate will become visible through the blush.

It is important that the binder composition be used in an insufficient amount to act as a complete matrix which will expell all air from the primary mass of light-scattering resin particles. Nevertheless, it is important that the binder composition be present in the blush coating so that it forms a continuous film and thereby contributes an important mechanical stabilization to the light-scattering particles until such time as an organic solvent or thermal means destroys the binder stabilization system and transparentizes the film. In the system illustrated below, the mass of light-scattering particles are not particularly susceptible to aliphatic solvents. They are readily susceptible to attack by organic solvents, e.g. aromatic solvents. Consequently, it is necessary that the binder itself be capable of sufficient attack by common aliphatic solvents (e.g. liquid alkanes, ketones, esters and alcohols) that it will lose its initial binding property and allow the light-translucent mass to coalesce. In fact, it is highly desirable to provide that the binder be coalesced by aromatic solvents also. Thus a binder susceptible to weakening by a broad range of solvents is believed to provide more sensitive detection of solvent tampering.

It is possible to reverse this procedure utilizing an aliphatic solvent-susceptible resin for the light-scattering particles and assuring that a binder system used with such particles be readily susceptible to mechanical destabilization by aromatic-type solvents. This, for example, could be achieved by utilizing microcrystalline wax particles and an aromatic-soluble binder as the binder system.

The binders of the invention, in addition to being susceptible to solvent and thermal attack, advantageously provide solvent-activatable plasticizer components which aid coalescence of the primary resin particles.

It should be understood that the amount of coalescence of a blush coating which is necessary to detect illicit tampering with solvents is less than the substantially complete change in a coating surface which has been thermally coalesced. Indeed, in such coatings as are described below, the binder system contains components which, on being attacked by solvent, will serve as plasticizers of the primary resin and aid in the coalescing action. In such cases, the plasticizer can be flushed from an immediate area on which the solvent is dropped and the major part of the coalescence will take place around that area, e.g. in a ring where a major portion of solvent-borne plasticizer is effective to aid coalescence.

It has been found desirable to have the solvent-susceptible binder portion of the blush-coating composition comprise about 10% to 25% by volume of the solid matter comprising the blush coating. "Solid matter" is defined to exclude any air or the like which is present within the coating.

Moreover, it is desirable that the binder be selected to destabilize mechanically when affected by heat below the temperature at which the light-scattering resin, were it alone present, would react. Thus, it is better practice to select a light-scattering primary resin having a particular thermalcoalescing characteristic and to reduce or "fine tune" the thermal temperature characteristics by formulation changes in the binder. In practice destabilization should occur between 150° and 200° F., although temperatures from 140° to 220° F. may be adequate for some applications.

The blush coating of the invention should serve as a means to allow detection of tampering with aromatic solvents such as toluene or benzene; alkyl derivatives of such aromatic solvents; chlorinated hydrocarbons such as carbon tetrachloride and other such halogenated solvents; aliphatic alcohols such as ethanol, isopropanol; aliphatic solvents such as deoderized kerosene, gasoline, and the like; ketones such as acetone and methyl ethyl ketone; esters such as ethyl acetate. In general, it will be seen that this list of generally available solvents covers a very broad range of solubility parameters based on a solvent's cohesive energy density, its hydrogen bonding capability, and its polarity characteristics. These solubility parameters are well known in the art and are described, among other places, in an article by Hansen entitled "The Three-Dimensional Solubility Parameters—Key to Paint Component Affinities" published in the Journal of Paint Technology (Volume 39, No. 505) of February 1957.

It is to be noted, however, that the blush coating of the invention must be so formulated to be resistant to water.

ILLUSTRATIVE EXAMPLE OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

IN THE DRAWINGS

Figure 1:
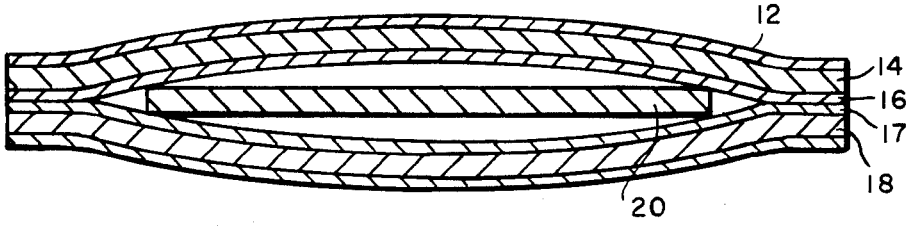
FIG. 1 is a schematic and fragmentary section of a secure pouch incorporating the blush-coating of the invention.

FIG. 1 illustrates a lottery pouch 10 which comprises a blush-coating 12 as described in Example 1, a colored paper 14 below the coating and a cohesive coating 16, e.g. cold seal coating, forming the means to seal one pouch-forming sheet comprising layers 12, 14 and 16 with another pouch-forming sheet comprising paper 18 backed with a cohesive coating 17. A lottery ticket or other item 20 is secured within the pouch. The cohesive coating 17 advantageously may also contain thermal and solvent-activated detection means as described in U.S. Pat. No. 4,120,445.

Figure 2:
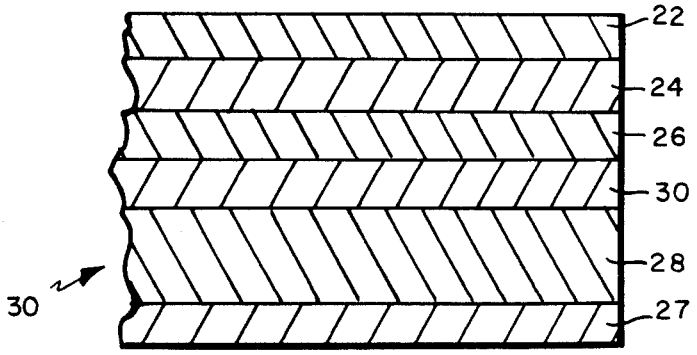
FIG. 2 is a schematic and fragmentary section of a lottery ticket incorporating a blush coating of the invention.
Figure 3:
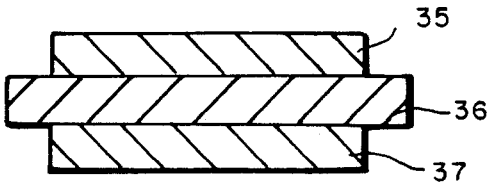

FIG. 2 is representative of a typical lottery ticket configuration 20.

FIG. 2 is a typical lottery-type card 20 comprising top to bottom, the following materials.

Scratch coating 22 is a typical coating material removed by mechanical abrasion action to reveal hidden indicia.

A thin tough transparent polymer 24, e.g. biaxially-oriented nylon to serve to protect the indicia from the aforesaid abrasion.

The indicia 26, e.g. a message, number or the like. Indicia 26 is printed on a blush coating 30. Blush coating 30 is applied to the colored side 28 of paper 27. A blush coating according to the invention overlies colored side 28 of paper 27.

The blush coating, in its light-scattering mode looks whitish and the color of side 28 is not visible. Once the coating coalesces to its transparent state, it reveals the colored sheet below it and thereby indicates tampering.

EXAMPLE 1

A composition is formed of the following materials:

| | Parts by Weight |
|---|---|
| Primary resin, a dispersion of polystyrene spheres | 79.00 |
| Wood rosin, soluble in common aromatic and aliphatic solvents and having a melting point of 167° F. | 1.58 |
| Antifoam | 0.04 |
| Ammonia (28% aqueous solution) | 1.58 |

A typical resin dispersion is that available under the trade designation LYTRON 2501 from Monsanto Company. It comprises 48% of non-volatiles.

The wood rosin is a hydrogenated rosin typically having an acid number of 158 and a saponification number of 161. It is obtained from Hercules Co. under the trade designation Staybelite Resin.

These ingredients are mixed thoroughly until the wood rosin is solubilized by the ammonia-bearing aqueous medium. About 5 to 10 minutes of moderate agitation is suitable.

Thereupon 5.93 parts of a dispersion of an aliphatic petroleum resin is added to the mixture and further stirring is carried out for about 10 minutes until this petroleum resin is well dispersed. This petroleum resin can be that sold under the trade designation Piccanol A102. It is sold as a 50% solids dispersion and has a softening point of about 200° F. before its incorporation into the mixture as described above.

After the aliphatic petroleum resin, 3.95 parts of liquid methyl ester of rosin is added. This material serves to modify binder resins so that they will lose mechanical-stability and become transparent at an appropriately depressed temperature. Thus, the liquid ester may be construed as a plasticizing, softening, or solubilizing component of the binder. One liquid ester of rosin can be obtained from Hercules Co. under the trade designation Abalyn. This material is characterized by a boiling point of from 352°-356° F.

Finally, 7.9 parts of a latex of a styrene-butadiene polymer is added to the mix. A suitable latex is that sold under the trademark Dow 202 at 48% solids. The resulting product is coated over the desired substrate, according to procedures well known in the art to a coating weight of 5 to 10 lbs., dry basis, per 3000 square feet.

Variations can be carried out in the formula to give temperature sensitivities of between 150°-220° F. One convenient way to vary this softening point is to vary the quantity of the Abalyn material, increased quantities tend to promote lower coalescing temperatures of the blush coating. However, a coating formed by the indicated formula will coalesce to a translucent coating at about 190°-200° F. Moreover, it is susceptible to such solvents as toluene, benzene, carbon tetrachloride, ethanol, and isopropanol, deoderized kerosene; gasoline, acetone, methyl ethyl ketone; and ethyl acetate.

EXAMPLE 2

A blush coating composition is formed as follows:

| | Parts by Weight |
|---|---|
| Dispersion of primary resin particles (48% solids) | 100 |
| Hydrocarbon Resin (50% solids) | 15 |

The primary resin is that sold under the trade designation Laticate 7548A by Pierce & Stevens. The hydrocarbon resin is that sold by Hercules under the trade designation Emulsion Piccanol A102. The hydrocarbon resin softens at about 200° F.

It is also to be understood that the following claims are intended to cover all of the generic and specific features of the invention herein described and all statements of the scope of the invention which might be said to fall therebetween.

What is claimed is:

1. A blush coating composition comprising a mass of light-scattering, primary resin particles which are adapted to coalesce to a more compact coating (a) on application of heat thereto, or (b) on exposure to aliphatic or aromatic solvent, said mass of particles being in intimate contact with a minor amount of a binder composition which, on exposure to any of a wide spectrum of aromatic or aliphatic solvents, will form a means to substantially impair the light-scattering character of said mass of particles and transform said mass of particles into a more compact, normally translucent, coating.

2. A blush coating composition as defined in claim 1, wherein said binder comprises solvent-leachable plasticizer components which form means to accelerate coalescence of said primary resin particles.

3. A blush coating composition as defined in claim 1 wherein said binder is thermally-activatable to allow coalescence of said primary resin particles at a temperature which is in the range of about 140°-220° F.

4. A blush coating composition as defined in claim 1 wherein said binder is present in the coating in a volume of 10-25% based on total volume of solids in said coating.

5. The blush coating composition of claim 1, wherein the primary resin particles coalesce on exposure to aromatic solvents, and the binder composition forms means to substantially impair the light-scattering character of the particles upon exposure to aliphatic solvents.

6. The blush coating composition of claim 1, wherein the primary resin particles coalesce on exposure to aliphatic solvents, and the binder composition forms means to substantially impair the light-scattering character of the particles upon exposure to aromatic solvents.

7. The blush coating composition of claim 1, wherein the binder is thermally activatable to allow coalescence of the primary resin particles at a temperature which is below the coalescence temperature of the primary resin particles when thermally activated without the binder.

8. A lottery ticket comprising, as an integral portion thereof, a means for detecting thermal and solvent tampering with said ticket, a blush coating comprised of a mass of light-scattering, polymeric particles which are adapted to coalesce to a more compact coating (a) on application of heat thereto or (b) on exposure to an aliphatic solvent or an aromatic solvent, the improvement wherein said mass of particles is in intimate contact with a minor amount of a binder composition which, on exposure to any of a wide spectrum of aromatic or aliphatic solvents, will form means to substantially impair the light-scattering character of said mass of polymeric particles and transform said mass of particles into a more compact, normally translucent coating.

9. A lottery ticket as defined in claim 8 wherein said binder comprises solvent-leachable plasticizer components which form means to accelerate coalescence of said light scattering particles.

10. A lottery ticket as defined in claim 8 wherein said binder is thermally-activatable to allow coalescence of said light-scattering resin at a temperature which is in the range of about 140°-220° F.

11. A lottery ticket as defined in claim 8 wherein said binder is present in the coating in a volume of 10-25% based on total volume of solids in said coating.

12. A lottery ticket as defined in claim 11 wherein said blush coating is adjacent a colored substrate and wherein, on being coalesced, said blush coating forms a translucent means to permit viewing of said colored substrate.

13. The lottery ticket of claim 8, wherein the polymeric particles coalesce on exposure to aromatic solvents, and the binder composition forms means to substantially impair the light scattering character of the particles upon exposure to aliphatic solvents.

14. The lottery ticket of claim 8, wherein the polymeric particles coalesce on exposure to aliphatic solvents, and the binder composition forms means to substantially impair the light scattering character of the particles upon exposure to aromatic solvents.

15. The lottery ticket of claim 8, wherein there binder is thermally activatable to allow coalescence of the polymeric particles at a temperature which is below the coalescence temperature of the primary resin particles when thermally activated without the binder.

16. A sheet material comprising (a) a polymer-based cohesive seal and (b) a polymer-based coating formed of small thermoplastic polymeric particles deposited in intimate contact with another within said, coating and wherein the appearance of said coating is irreversibly and substantially changed by subjecting said polymeric particles to temperatures of at least 140° F., said polymer-based coating comprising a binder composition with a solvent-leachable plasticizer component forming means to accelerate said change in appearance.

17. A secure package resistant to undetectable inspection and formed of the sheet material as defined in claim 16 and comprising therewithin articles marked for indicating a winning or losing status in a lottery system.

18. A sheet material as defined in claim 16 wherein said binder is thermally-activatable to allow coalescence of said particles at a temperature which is in the range of about 140°-220° F.

19. A sheet material as defined in claim 16 wherein said binder is present in the polymer-based coating in a volume of 10-25% based on total volume of solids in said coating.

20. A sheet material as defined in claim 16 wherein said polymer-based coating is adjacent a colored substrate and wherein, on being coalsced, said blush coating forms translucent means to permit viewing of said colored substrate.

21. The sheet material of claim 16, wherein the polymeric particles coalesce on exposure to aromatic solvents, and the binder composition forms means to substantially impair the light scattering character of the particles upon exposure to aliphatic solvents.

22. The sheet material of claim 16, wherein the polymeric particles coalesce on exposure to aliphatic solvents, and the binder composition forms means to substantially impair the light scattering character of the particles upon exposure to aromatic solvents.

23. The sheet material of claim 16, wherein the binder is thermally activatable to allow coalescence of the polymeric particles at a temperature which is below the coalescence temperature of the primary resin particles when thermally activated without the binder.

* * * * *